US005868462A

United States Patent [19]

Truax

[11] Patent Number: 5,868,462

[45] Date of Patent: Feb. 9, 1999

[54] SHOULDER MOUNTED SEAT AND CARGO SUPPORT

[76] Inventor: Gary E. Truax, HC 1 Box 61C, Crystal Spring, Pa. 15536

[21] Appl. No.: 74,154

[22] Filed: May 7, 1998

[51] Int. Cl.[6] ..... A45F 4/02

[52] U.S. Cl. ..... 297/129; 224/155; 224/261

[58] Field of Search ..... 297/129, 188.04, 297/452.14, 468; 224/155, 261, 262, 214, 651

[56] References Cited

U.S. PATENT DOCUMENTS

| | | | |
|---|---|---|---|
| 3,669,489 | 6/1972 | Rock | 297/129 |
| 3,904,243 | 9/1975 | Kostelec et al. | 297/452.14 |
| 4,300,707 | 11/1981 | Kjaer | 297/129 X |
| 4,450,990 | 5/1984 | Bolstad | 224/155 |
| 4,480,775 | 11/1984 | Stanford | 224/261 X |
| 4,593,841 | 6/1986 | Lange | 224/261 X |
| 4,720,029 | 1/1988 | Varanakis | 224/155 |
| 4,836,938 | 6/1989 | Kobasic | 224/261 X |
| 5,527,089 | 6/1996 | Charest | 224/155 X |
| 5,607,089 | 3/1997 | Strum | 224/155 |

*Primary Examiner*—Peter R. Brown

[57] ABSTRACT

A back pack support which doubles as a seat is provided including a rigid frame including a vertically oriented plate and a horizontally oriented plate. The horizontally oriented plate has an inboard edge integrally coupled to a bottom edge of the vertically oriented plate and extended therefrom in perpendicular relationship therewith. Mounted on a front face of the vertically oriented plate is a pair of shoulder straps for allowing the frame to be worn on a back of a user.

5 Claims, 2 Drawing Sheets

SHOULDER MOUNTED SEAT AND CARGO SUPPORT

BACKGROUND OF THE INVENTION

1. Field of the Invention

The present invention relates to back packs and more particularly pertains to a new shoulder mounted seat and cargo support for supporting cargo on a back of a user with a device that also serves as a seat.

2. Description of the Prior Art

The use of back packs is known in the prior art. More specifically, back packs heretofore devised and utilized are known to consist basically of familiar, expected and obvious structural configurations, notwithstanding the myriad of designs encompassed by the crowded prior art which have been developed for the fulfillment of countless objectives and requirements.

Known prior art back packs include U.S. Pat. No. 5,209,381; U.S. Pat. No. 5,409,291; U.S. Pat. No. 4,392,598; U.S. Pat. No. 2,973,888; U.S. Pat. No. 2,843,185; and Foreign Patents WO 93/18688 & WO 97/01299.

In these respects, the shoulder mounted seat and cargo support according to the present invention substantially departs from the conventional concepts and designs of the prior art, and in so doing provides an apparatus primarily developed for the purpose of supporting cargo on a back of a user with a device that also serves as a seat.

SUMMARY OF THE INVENTION

In view of the foregoing disadvantages inherent in the known types of back packs now present in the prior art, the present invention provides a new shoulder mounted seat and cargo support construction wherein the same can be utilized for supporting cargo on a back of a user with a device that also serves as a seat.

The general purpose of the present invention, which will be described subsequently in greater detail, is to provide a new shoulder mounted seat and cargo support apparatus and method which has many of the advantages of the back packs mentioned heretofore and many novel features that result in a new shoulder mounted seat and cargo support which is not anticipated, rendered obvious, suggested, or even implied by any of the prior art back packs, either alone or in any combination thereof.

To attain this, the present invention generally comprises a rigid frame including a vertically oriented plate with a rectangular configuration. The frame also includes a horizontally oriented plate with a rectangular configuration. As shown in FIG. 1, the horizontally oriented plate has an inboard edge integrally coupled to a bottom edge of the vertically oriented plate. The horizontally oriented plate thus extends from the vertically oriented plate in perpendicular relationship therewith. The frame further includes a pair of side rails integrally coupled along side edges of a rear face of both the plates. The side rails preferably extend perpendicularly from the associated plate. For strengthening purposes, a pair of triangular webs are integrally coupled between an intersection of the side rails of the vertically oriented plate and the side rails of the horizontally oriented plate. The frame further includes a downwardly extending lip integrally coupled to an outboard edge of the horizontally oriented plate and extending downwardly in perpendicular relationship with the horizontally oriented plate. For allowing the frame to be carried on a back of a user, a pair of closed loop shoulder straps each pass through a pair of vertically spaced horizontal slits formed in the vertically oriented plate adjacent to one of the side edges thereof. The shoulder straps each have a waist strap coupled thereto. The waist straps have free ends which are securable about a waist of a user. Note FIGS. 3 and 4. FIGS. 1 & 2 show a pair of cargo straps each passing through a pair of horizontally spaced vertical slits formed in the vertically oriented plate. The cargo straps reside adjacent to the top edge and bottom edge of the vertically oriented plate. Each of the cargo straps have a fastener, in the form of a buckle, mounted thereon for allowing the cargo straps to be secured about cargo situated on the horizontally oriented plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoulder mounted seat and cargo support apparatus and method which has many of the advantages of the back packs mentioned heretofore and many novel features that result in a new shoulder mounted seat and cargo support which is not anticipated, rendered obvious, suggested, or even implied by any of the prior art back packs, either alone or in any combination thereof.

It is another object of the present invention to provide a new shoulder mounted seat and cargo support which may be easily and efficiently manufactured and marketed.

It is a further object of the present invention to provide a new shoulder mounted seat and cargo support which is of a durable and reliable construction.

An even further object of the present invention is to provide a new shoulder mounted seat and cargo support which is susceptible of a low cost of manufacture with regard to both materials and labor, and which accordingly is then susceptible of low prices of sale to the consuming public, thereby making such shoulder mounted seat and cargo support economically available to the buying public.

Still yet another object of the present invention is to provide a new shoulder mounted seat and cargo support which provides in the apparatuses and methods of the prior art some of the advantages thereof, while simultaneously overcoming some of the disadvantages normally associated therewith.

Still another object of the present invention is to provide a new shoulder mounted seat and cargo support for supporting cargo on a back of a user with a device that also serves as a seat.

Even still another object of the present invention is to provide a new shoulder mounted seat and cargo support that includes a rigid frame having a vertically oriented plate and a horizontally oriented plate. The horizontally oriented plate has an inboard edge integrally coupled to a bottom edge of the vertically oriented plate and extended therefrom in perpendicular relationship therewith. Mounted on a front face of the vertically oriented plate is a pair of shoulder straps for allowing the frame to be worn on a back of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
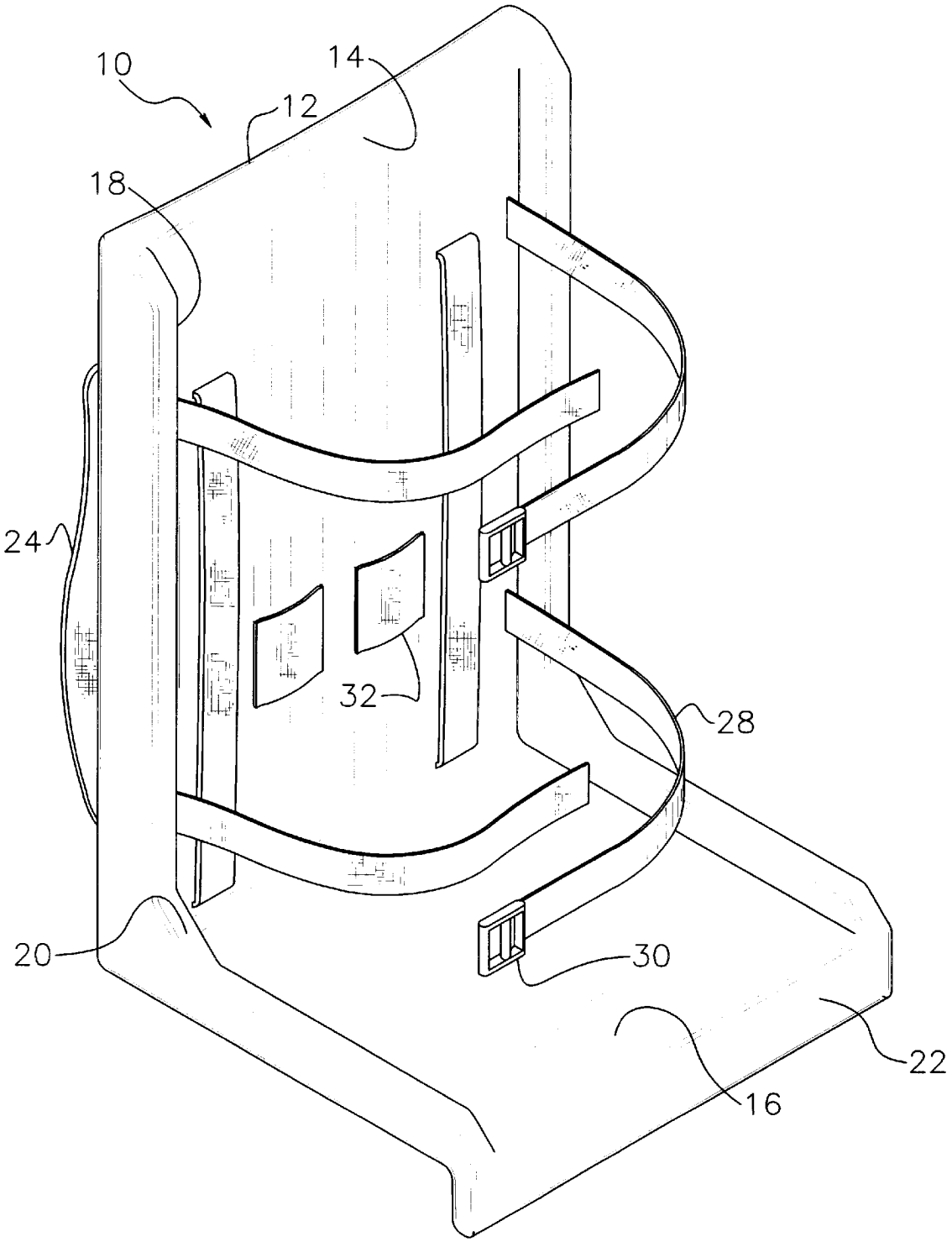
FIG. 1 is a perspective view of a new shoulder mounted seat and cargo support according to the present invention.

With reference now to the drawings, and in particular to FIGS. 1 through 4 thereof, a new shoulder mounted seat and cargo support embodying the principles and concepts of the present invention and generally designated by the reference numeral 10 will be described.

The present invention, designated as numeral 10, includes a rigid frame 12 having a vertically oriented plate 14 with a generally planar rectangular configuration. The frame also includes a horizontally oriented plate 16 also with a generally planar rectangular configuration. It should be noted that each plate define slightly arcuate, smooth surfaces. As shown in FIG. 1, the horizontally oriented plate has an inboard edge integrally and fixedly coupled to a bottom edge of the vertically oriented plate.

The horizontally oriented plate thus extends from the vertically oriented plate in perpendicular relationship therewith. As best shown in FIG. 1, the horizontally oriented plate has a width equal to that of the vertically oriented plate and length about ½ that of the vertically oriented plate. The present invention thus serves as a seat when the horizontally oriented plate is rested on a recipient surface.

The frame further includes a pair of side rails 18 integrally coupled along side edges of a rear face of both the plates. The side rails preferably extend perpendicularly from the associated plate. It should be noted that outboard edges of the side rails each have an arcuate cross-section along an entire length thereof so as not to afford a user any discomfort when seated thereon. Further, the side rails further have beveled ends, as shown in FIG. 1. For strengthening purposes, a pair of triangular webs 20 are integrally coupled between an intersection of the side rails of the vertically oriented plate and the side rails of the horizontally oriented plate.

The frame further includes a downwardly extending lip 22 integrally coupled to an outboard edge of the horizontally oriented plate and extending downwardly in perpendicular relationship with the horizontally oriented plate. In use, an underside of the horizontally oriented plate and the downwardly extending plate may be rested on a rock or any similar entity. As such, the plates may be reclined rearwardly during use.

For allowing the frame to be carried on a back of a user, a pair of closed loop shoulder straps 24 each pass through a pair of vertically spaced horizontal slits formed in the vertically oriented plate adjacent to one of the side edges thereof. The shoulder straps each have a waist strap 26 coupled to its lower portion. The waist straps have free ends which are securable about a waist of a user. Note FIGS. 3 and 4.

Figure 2:
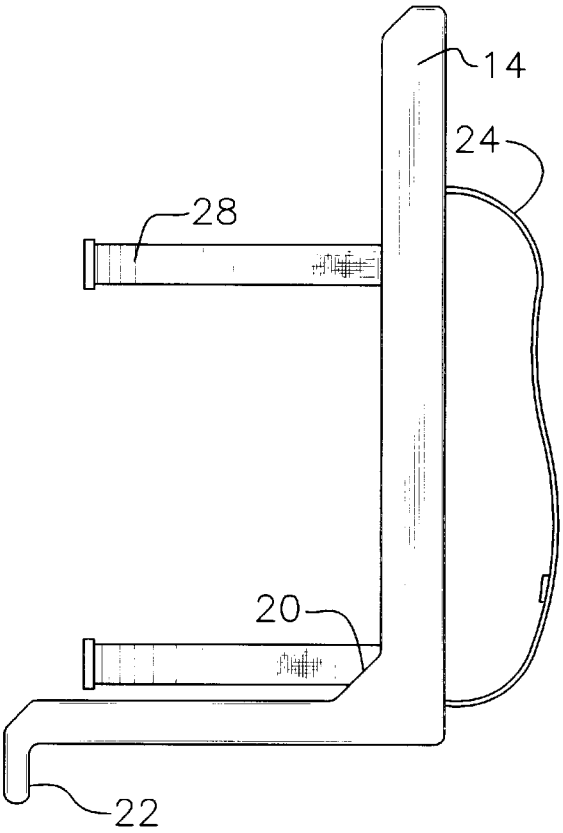
FIG. 2 is a side view of the present invention.
Figure 3:
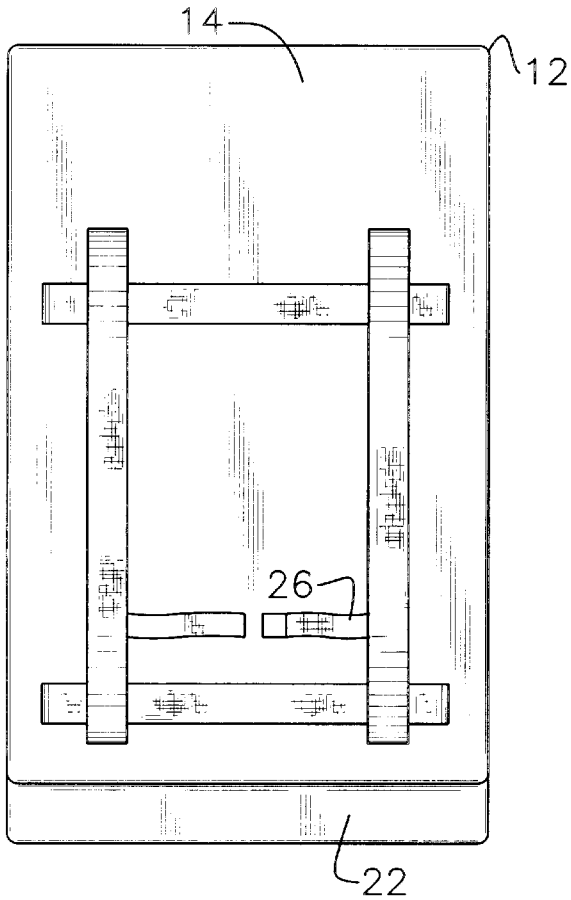
FIG. 3 is a rear view of the present invention.
Figure 4:
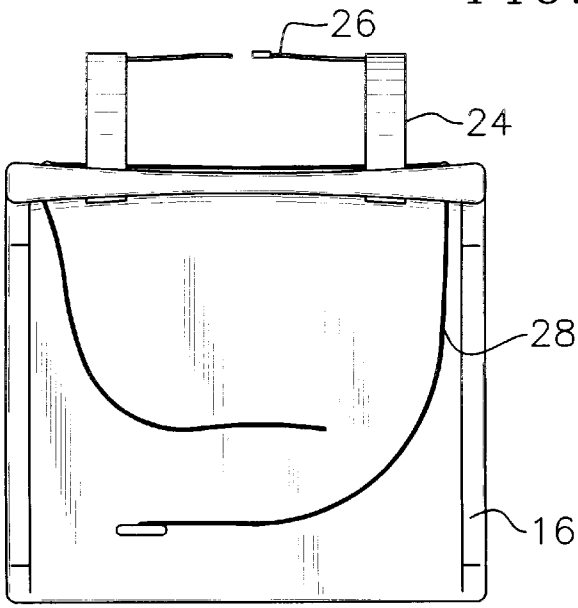
FIG. 4 is a top view of the present invention.

FIGS. 1 & 2 show a pair of elongated cargo straps 28 each passing through a pair of horizontally spaced vertical slits formed in the vertically oriented plate. The cargo straps reside adjacent to the top edge and bottom edge of the vertically oriented plate. Each of the cargo straps have a fastener 30, in the form of a buckle, mounted thereon for allowing the cargo straps to be secured about cargo situated on the horizontally oriented plate. As shown in FIG. 3, the slits associated with the shoulder and cargo straps are preferably situated adjacent to each other to define a square.

Finally, a pair of horizontally spaced pockets 32 are situated on the rear face of the vertically oriented plate adjacent to its bottom edge. Each pocket includes a square piece of elastic material having side edges and a bottom edge coupled to the vertically oriented plate. The pockets each thus define an interior space which is accessible from an open top for housing a pair of hand warmers or other heat transferring mechanisms. In use, the pockets maintain such entities proximate to the kidneys of a user sitting on the frame.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A back pack support which doubles as a seat comprising, in combination:

a rigid frame including a vertically oriented plate with a rectangular configuration and a horizontally oriented plate with a rectangular configuration, wherein the plates define flat smooth surfaces, the horizontally oriented plate having an inboard edge integrally coupled to a bottom edge of the vertically oriented plate and extending therefrom in perpendicular relationship therewith, wherein the horizontally oriented plate has a width substantially equal to that of the vertically oriented plate and a length substantially ½ that of the vertically oriented plate, the frame further including a pair of side rails with beveled ends integrally coupled along side edges of a rear face of both the plates and extending therefrom perpendicularly, a pair of triangular webs integrally coupled between an intersection of the side rails of the vertically oriented plate and the side rails of the horizontally oriented plate, and a downwardly extending lip integrally coupled to an outboard edge of the horizontally oriented plate and extending downwardly in perpendicular relationship with the horizontally oriented plate for being supported on a rock to recline the frame;

a pair of closed loop shoulder straps each passing through a pair of vertically spaced horizontal slits formed in the vertically oriented plate adjacent to one of the side edges thereof, the shoulder straps each having a waist strap coupled thereto, wherein the waist straps have free ends which are securable about a waist of a user;

a pair of cargo straps each passing through a pair of horizontally spaced vertical slits formed in the vertically oriented plate adjacent to a top edge and a bottom edge thereof, each of the cargo straps having a fastener mounted thereon for allowing the cargo straps to be secured about cargo situated on the horizontally oriented plate; and a pair of horizontally spaced pockets situated on the rear face of the vertically oriented plate adjacent to the bottom edge thereof, each pocket including a square piece of elastic material having side edges and a bottom edge coupled to the vertically oriented plate for defining an interior space which is accessible from an open top, the pockets adapted for receiving temperature packs and positioning the packs adjacent to kidneys of the user.

2. A back pack support which doubles as a seat comprising:

a rigid frame including a vertically oriented plate and a horizontally oriented plate, the horizontally oriented plate having an inboard edge integrally coupled to a bottom edge of the vertically oriented plate and extending therefrom in perpendicular relationship therewith, the rigid frame including a downwardly extending lip integrally coupled to an outboard edge of the horizontally oriented plate and extending downwardly in perpendicular relationship with the horizontally oriented plate for being supported on a rock to recline the frame;

a pair of shoulder straps mounted on a front face of the vertically oriented plate for allowing the frame to be worn on a back of a user; and a pair of horizontally spaced pockets situated on the rear face of the vertically oriented plate adjacent to the bottom edge thereof, each pocket including a square piece of elastic material having side edges and a bottom edge coupled to the vertically oriented plate for defining an interior space which is accessible from an open top, the pockets adapted for receiving temperature packs and positioning the packs adjacent to kidneys of the user.

3. A back pack support as set forth in claim 2 wherein at least one cargo strap is mounted to a rear face of the vertically oriented plate for securing cargo thereon.

4. A back pack support as set forth in claim 2 wherein a pair of side rails are formed along side edges of at least one of the plates.

5. A back pack support as set forth in claim 2 wherein a pair of webs are formed between an interconnection of the plates for strengthening purposes.

* * * * *